US009957874B2

(12) United States Patent
Dudar

(10) Patent No.: US 9,957,874 B2
(45) Date of Patent: May 1, 2018

(54) ENGINE COOLING FAN OPERATION DURING HOT SOAK

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 304 days.

(21) Appl. No.: 14/788,244

(22) Filed: Jun. 30, 2015

(65) Prior Publication Data

US 2017/0002719 A1 Jan. 5, 2017

(51) Int. Cl.
*F01P 7/02* (2006.01)
*F01P 1/06* (2006.01)

(52) U.S. Cl.
CPC ..... *F01P 1/06* (2013.01); *F01P 2031/30* (2013.01)

(58) Field of Classification Search
CPC ..... F01P 2025/70; F01P 1/06; F01P 2031/30; F01P 5/02; F01P 5/043; F01P 7/02; F01P 7/026; F01P 7/048; F01P 7/10; F01P 7/12; F01P 2007/168; F02M 2025/0881
USPC ..... 123/41.12, 41.65, 41.21, 518, 519
See application file for complete search history.

(56) References Cited

U.S. PATENT DOCUMENTS

| | | | | |
|---|---|---|---|---|
| 7,017,701 | B2 | 3/2006 | Flynn et al. | |
| 7,121,368 | B2 | 10/2006 | MacKelvie | |
| 2003/0183433 | A1* | 10/2003 | MacKelvie | B60K 11/00 180/68.1 |
| 2013/0047955 | A1* | 2/2013 | Reedy | B60T 10/00 123/320 |
| 2014/0224468 | A1* | 8/2014 | Saito | F01P 7/08 165/200 |

* cited by examiner

*Primary Examiner* — Lindsay Low
*Assistant Examiner* — Omar Morales
(74) *Attorney, Agent, or Firm* — James Dottavio; McCoy Russell LLP

(57) ABSTRACT

Methods and systems are provided for cooling an engine. In one example, a method for an engine, includes, after an engine shutdown request is received, adjusting an engine cooling fan based on an engine temperature and an elevation of a fuel tank relative to the engine. In this way, fuel vapor generation may be prevented during an engine hot soak.

19 Claims, 7 Drawing Sheets

ENGINE COOLING FAN OPERATION DURING HOT SOAK

FIELD

The present description relates generally to methods and systems for controlling an engine cooling fan to transfer engine heat away from a fuel tank following an engine shutdown.

BACKGROUND/SUMMARY

Vehicle fuel systems may include a carbon canister to adsorb fuel vapors resulting from refueling, diurnal temperature swings, heat rejection following engine shutdown, and running loss. Once the canister is loaded with vapors, engine running manifold vacuum is used to clean out the canister in a process known as purging. When a vehicle is driven on a hot day, even after the engine is shutdown, heat from the hot engine persists or even increases and can transfer to the fuel tank and cause fuel vapor generation, a process referred to as hot soak. Vapor generation from an engine hot soak is undesirable since it loads the canister. Too much loading of the carbon canister can result in breakthrough of hydrocarbons (HC) to the atmosphere.

Other attempts to manage engine heat rejection in a vehicle include operating an engine cooling fan to cool the engine when the vehicle is stopped. One example approach is shown by MacKelvie in U.S. Pat. No. 7,121,368. Therein, an engine cooling fan associated with a radiator is operated in a reverse direction when the vehicle is moving slowly or is stopped to draw outside air from beneath the vehicle and through the engine bay thereby cooling the engine surface, components in the engine bay, and the firewall of the vehicle's interior. However, the inventors herein have recognized potential issues with such systems. As one example, engine heat rejection may only lead to fuel vapor generation when the engine heat actually travels to the fuel tank, and operation of the engine cooling fan when engine cooling is not warranted wastes energy. For example, when a vehicle is parked on a grade, the engine may be positioned vertically above the fuel tank, and hence heat from the engine naturally rises away from the fuel tank. Operation of the engine cooling fan during these conditions may not reduce fuel vapor generation and thus may waste energy.

In one example, the issues described above may be addressed by a method for an engine, including, after an engine shutdown request is received, adjusting an engine cooling fan based on an engine temperature and an elevation of a fuel tank relative to the engine. In this way, by taking into account the elevation of the fuel tank relative to the engine, the engine cooling fan may be operated in reverse with the engine at rest only when the fuel tank is vertically above the engine and stopped, and hence is positioned to receive heat rising above the engine.

As one example, the cooling fan may be adjusted to operate in a reverse direction such that air surrounding the engine is forced outside of the vehicle and away from the fuel tank. Then, during normal engine operation when engine cooling is indicated, the engine cooling fan may be operated in a forward direction to direct ambient air over the engine and fuel tank. By doing so, the engine cooling fan may be operated in a direction that provides optimal air movement away from the engine or fuel tank while taking into account the vehicle grade and hence the amount of heat actually transferred to the fuel tank to the engine, thus avoiding unnecessary operation of the engine cooling fan.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for controlling operation of an engine cooling fan. In one example, the engine cooling fan may be associated with a radiator or other heat exchanger and may be operated in a forward direction to draw outside air into the vehicle and over the radiator, engine, and/or other engine components to lower engine coolant temperature. The engine cooling fan may be configured to also operate in a reverse direction to draw ambient engine air (e.g., air from the vehicle surrounding the engine and associated components) out of the vehicle and to the environment. The engine cooling fan may be operated in the reverse direction when the engine is shutdown or the vehicle is not moving and engine temperature and/or ambient temperature is above a threshold temperature, to ensure the engine does not overheat and to prevent heat from the engine from being transferred to a fuel tank, where the heat could generate fuel vapors that may eventually be released to the atmosphere.

Figure 1:
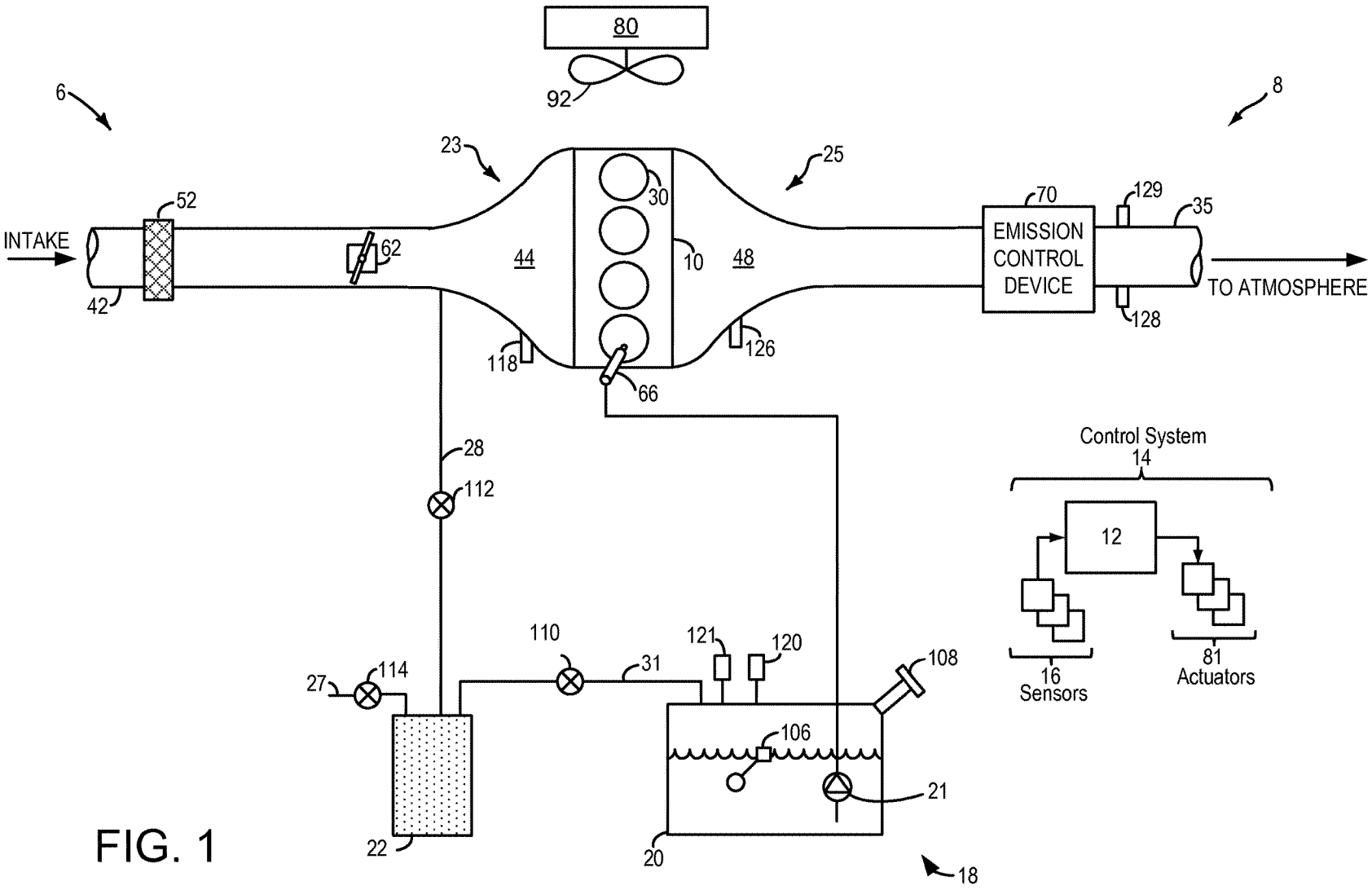
FIG. 1 shows an example vehicle system.
Figure 2A:
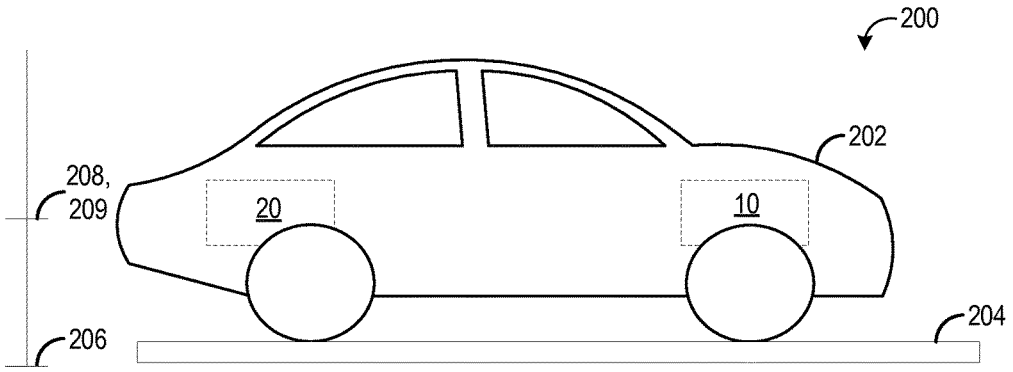
FIGS. 2A-2C show an example vehicle including the vehicle system of FIG. 1 parked at various grades and corresponding effects on fuel tank and engine elevation.
Figure 2B:
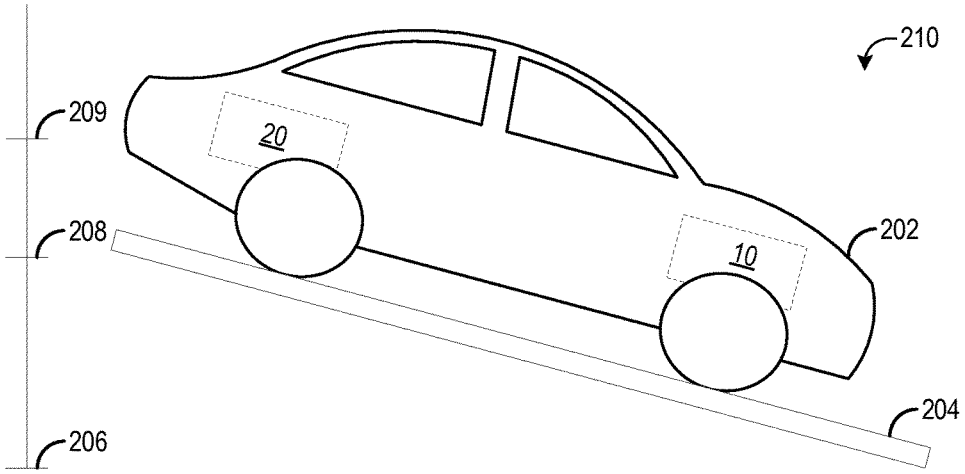
Figure 2C:
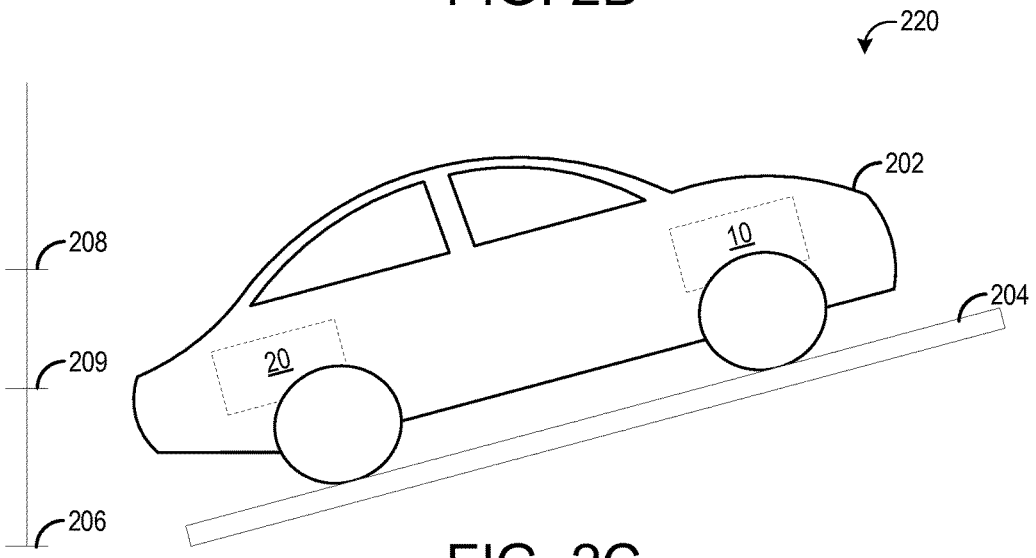
Figure 3:
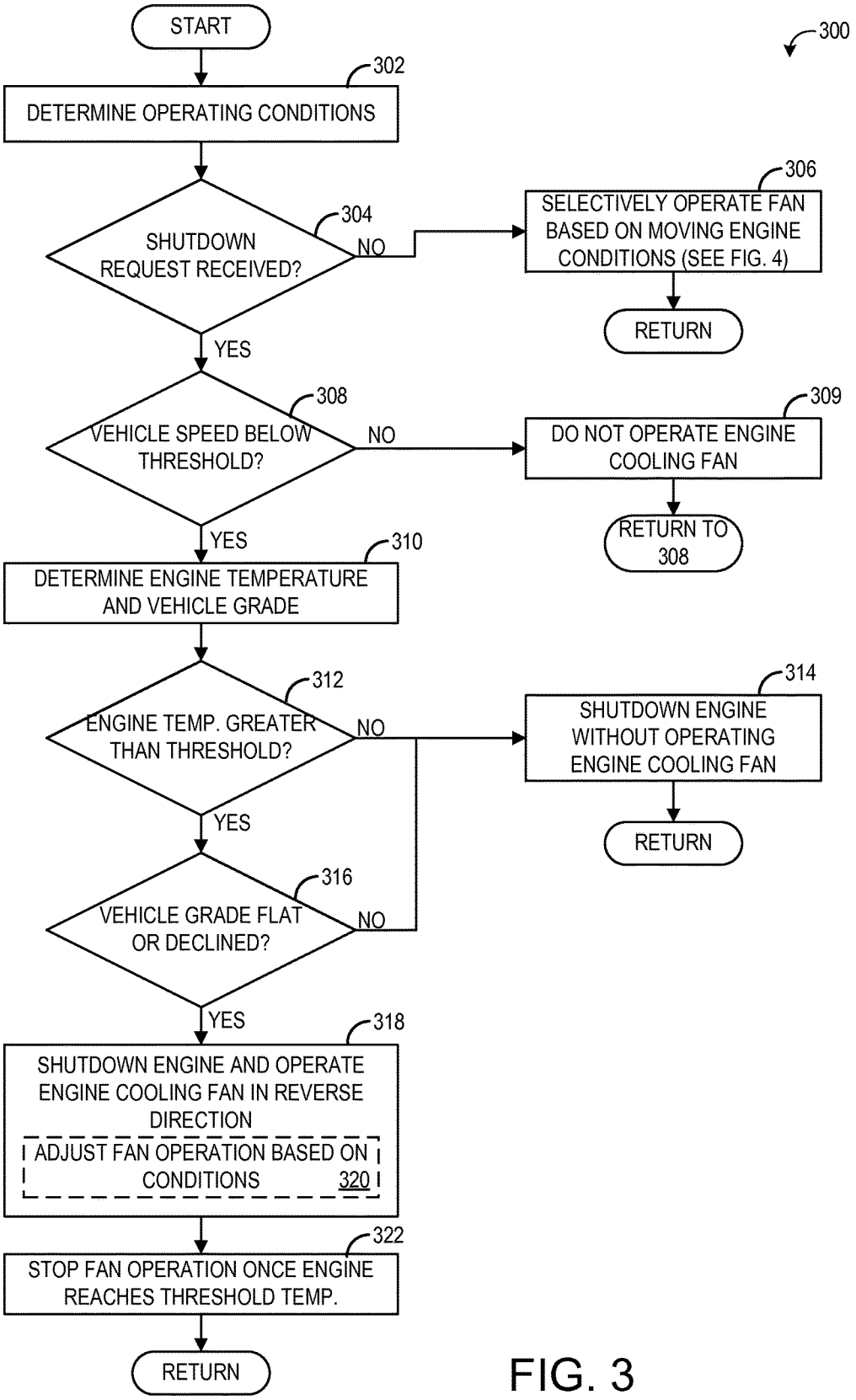
FIG. 3 is a flow chart illustrating an example method for operating an engine cooling fan.
Figure 4:
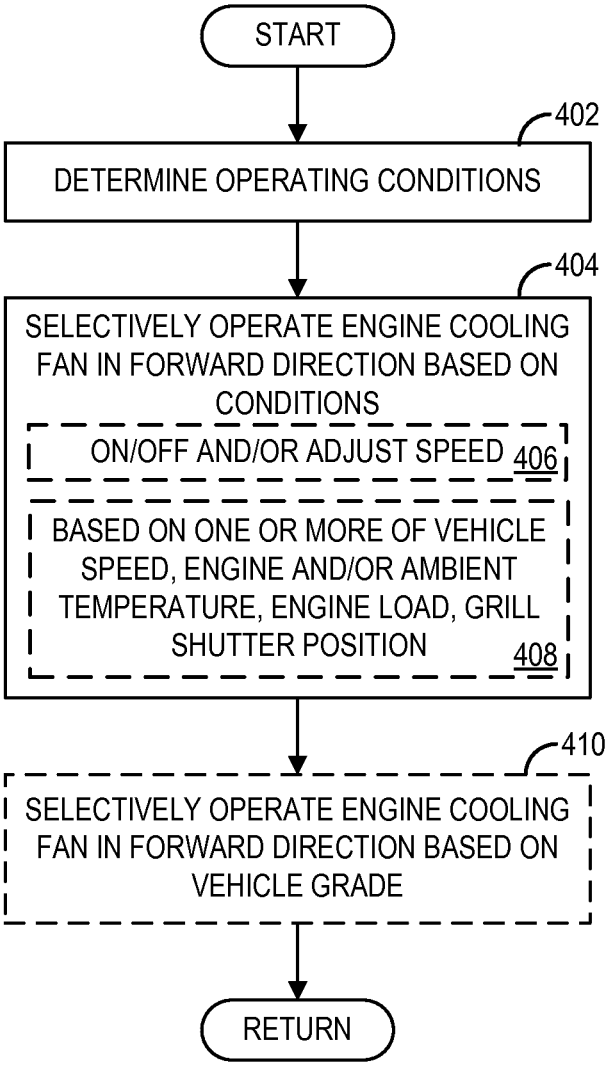
FIG. 4 is a flow chart illustrating another example method for operating an engine cooling fan.
Figure 5:
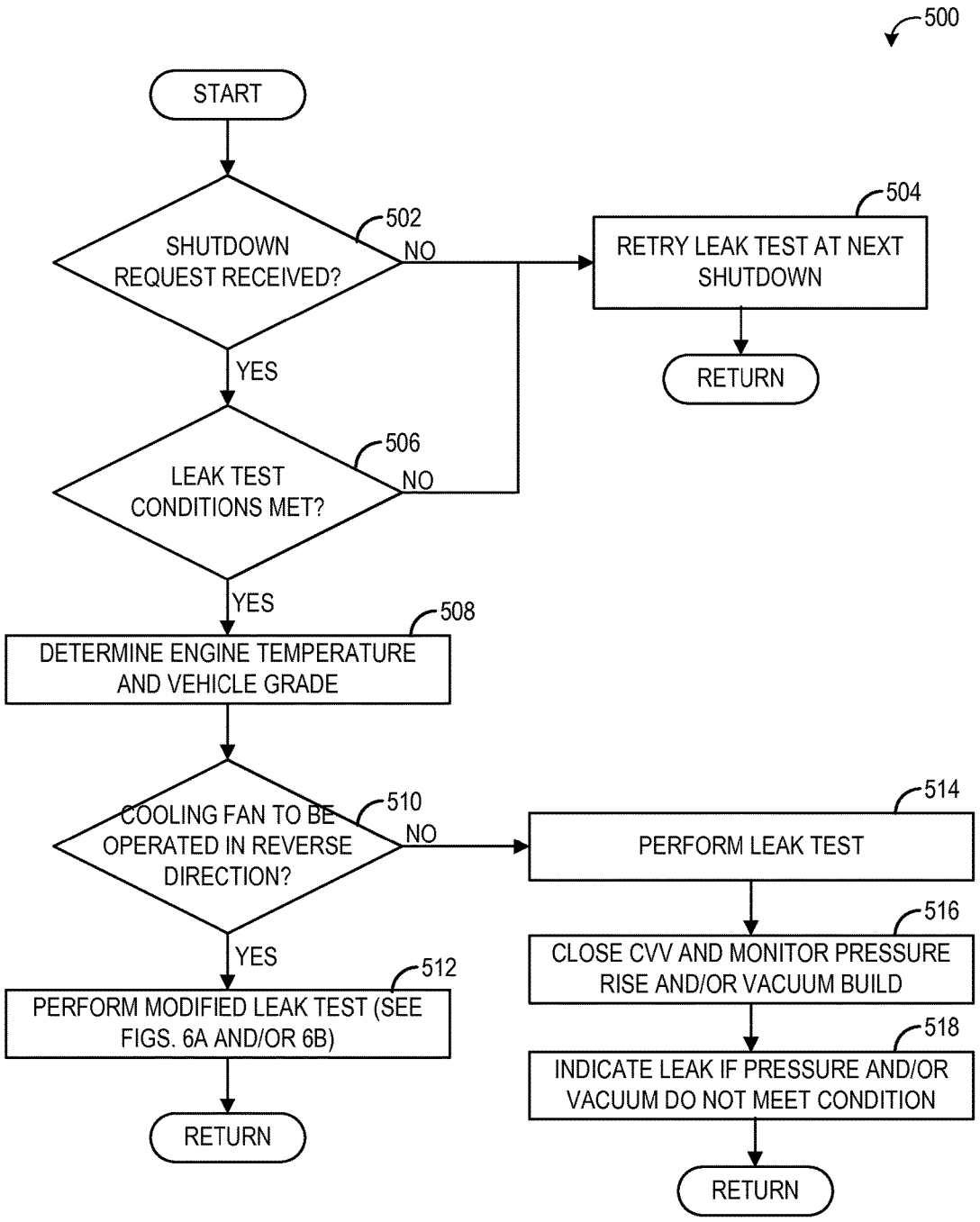
FIG. 5 is a flow chart illustrating an example method for performing a leak detection test.
Figure 6A:
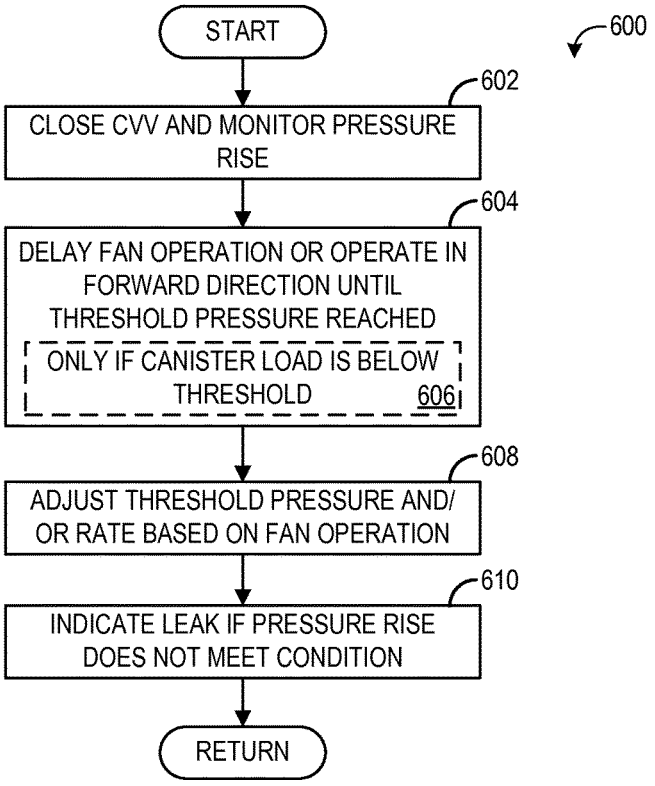
FIGS. 6A and 6B are flow charts illustrating example methods for performing a modified leak detection test.
Figure 6B:
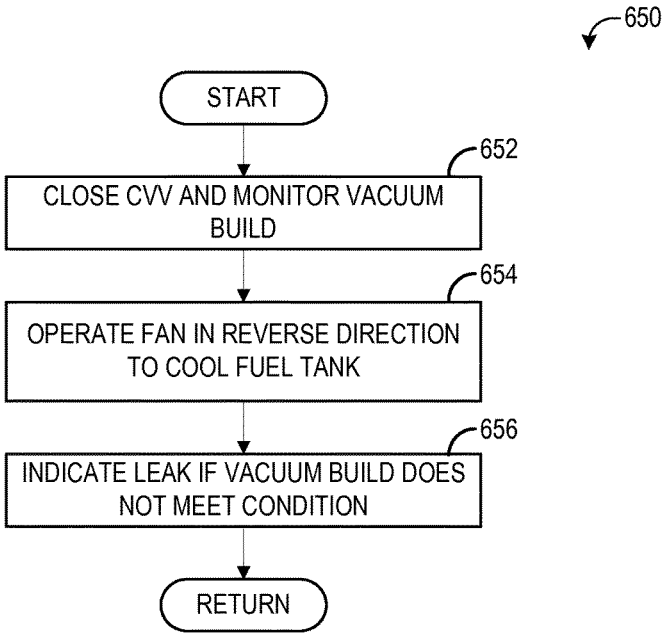
Figure 7:
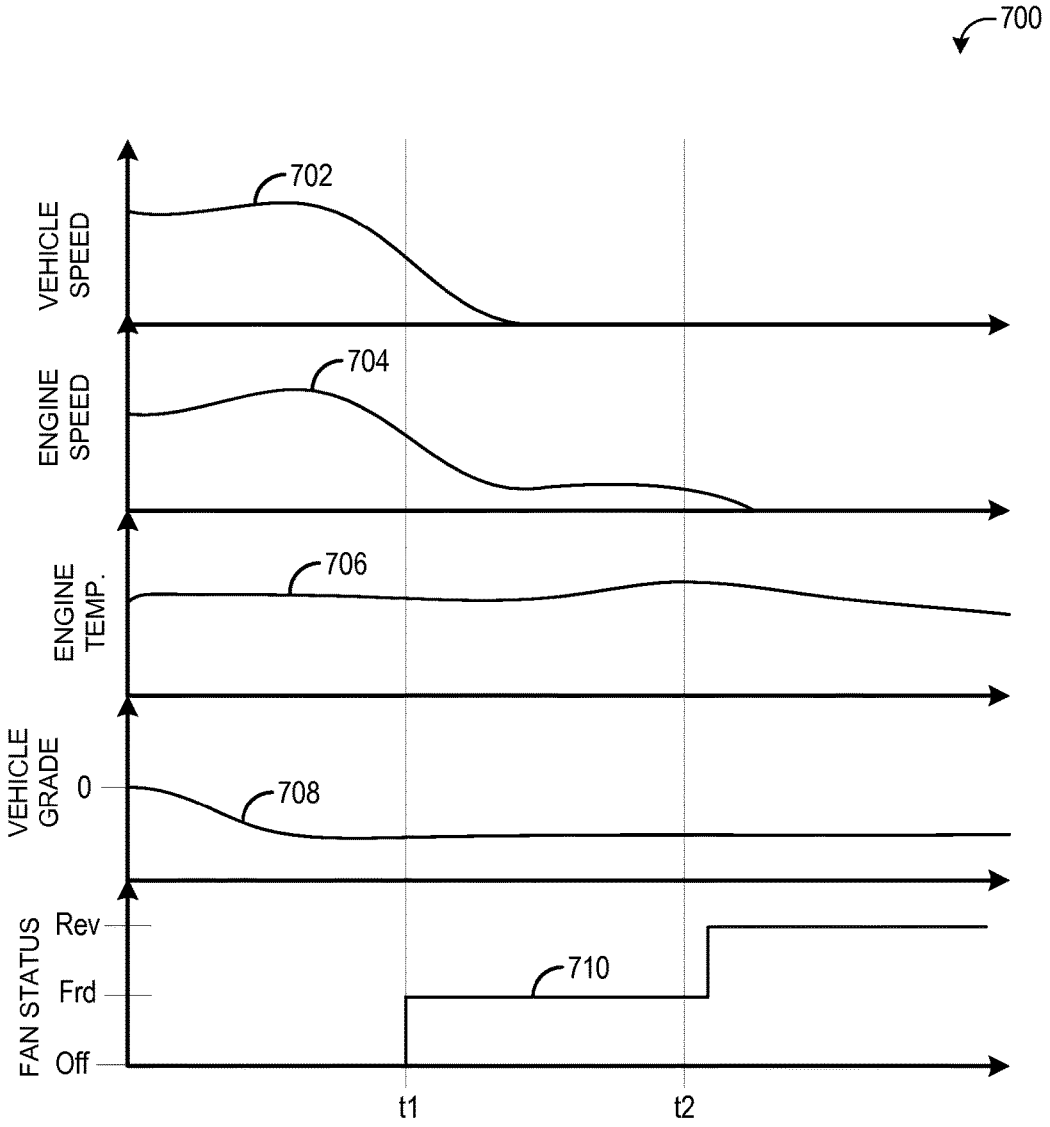
FIG. 7 is a diagram illustrating example parameters of interest.

The engine cooling fan may additionally be adjusted based on vehicle grade or the elevation of the fuel tank relative to the engine. For example, even if the engine temperature is above the threshold, if the vehicle is positioned nose-up (e.g., parked on an incline), the engine fan may not be operated, as the engine is above the fuel tank and heat will naturally rise away from the engine. In another example, if the vehicle is positioned nose-down (e.g., parked on a decline), the engine fan may be operated at a lower engine temperature than if the vehicle were positioned on a flat surface, due to the engine being positioned vertically below the fuel tank. Further, in some examples, the speed of the engine fan may be adjusted based on the vehicle grade. An example vehicle system including an engine, fuel tank, engine cooling fan, and controller is illustrated in FIG. 1. FIGS. 2A-2C show a vehicle including the vehicle system of FIG. 1 parked on a flat surface (FIG. 2A), at a decline (FIG. 2B), and at an incline (FIG. 2C), with corresponding effects on fuel tank and. engine elevation. The controller of the vehicle system of FIG. 1 may include instructions to control the engine cooling fan according to various operating parameters, such as engine temperature and vehicle grade, as illustrated by the methods of FIGS. 3-4. The controller of the vehicle system may include further instructions to carry out a leak detection test, as illustrated by the methods of FIGS. 5, 6A, and 6B. Example parameters of interest that may be observed in the engine system of FIG. 1 are illustrated in the diagram of FIG. 7.

FIG. 1 shows a schematic depiction of a vehicle system 6 that can derive propulsion power from engine system 8 and/or an on-board energy storage device, such as a battery system. An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 8 is coupled to a fuel system 18. Fuel system 18 includes a fuel tank 20 coupled to a fuel pump 21 and a fuel vapor canister 22. During a fuel tank refueling event, fuel may be pumped into the vehicle from an external source through refueling port 108. Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor canister 22, via conduit 31, before being purged to the engine intake 23.

Fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23 by opening canister purge valve 112. While a single canister 22 is shown, it will be appreciated that fuel system 18 may include any number of canisters. In one example, canister purge valve 112 may be a solenoid valve wherein opening or closing of the valve is performed via actuation of a canister purge solenoid.

Canister 22 includes a vent 27 for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28 and purge valve 112. While this example shows vent 27 communicating with fresh, unheated air, various modifications may also be used. Vent 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. In one example, canister vent valve 114 may be a solenoid valve wherein opening or closing of the valve is performed via actuation of a canister vent solenoid. In particular, the canister vent valve may be an open that is closed upon actuation of the canister vent solenoid.

As such, vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, a fuel tank isolation valve 110 may be optionally included in conduit 31 such that fuel tank 20 is coupled to canister 22 via the valve. During regular engine operation, isolation valve 110 may be kept closed to limit the amount of diurnal or "running loss" vapors directed to canister 22 from fuel tank 20. During refueling operations, and selected purging conditions, isolation valve 110 may be temporarily opened, e.g., for a duration, to direct fuel vapors from the fuel tank 20 to canister 22. By opening the valve during purging conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits. While the depicted example shows isolation valve 110 positioned along conduit 31, in alternate embodiments, the isolation valve may be mounted on fuel tank 20.

One or more pressure sensors 120 may be coupled to fuel system 18 for providing an estimate of a fuel system pressure. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 directly coupled to fuel tank 20, in alternate embodiments, the pressure sensor may be coupled between the fuel tank and canister 22, specifically between the fuel tank and isolation valve 110. In still other embodiments, a first pressure sensor may be positioned upstream of the isolation valve (between the isolation valve and the canister) while a second pressure sensor is positioned downstream of the isolation valve (between the isolation valve and the fuel tank), to provide an estimate of a pressure difference across the valve. In some examples, a vehicle control system may infer and indicate a fuel system leak based on changes in a fuel tank pressure during a leak diagnostic routine.

One or more temperature sensors 121 may also be coupled to fuel system 18 for providing an estimate of a fuel system temperature. In one example, the fuel system temperature is a fuel tank temperature, wherein temperature sensor 121 is a fuel tank temperature sensor coupled to fuel tank 20 for estimating a fuel tank temperature. While the depicted example shows temperature sensor 121 directly coupled to fuel tank 20, in alternate embodiments, the temperature sensor may be coupled between the fuel tank and canister 22.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) or manifold vacuum (ManVac) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode (e.g., during a fuel tank refueling operation and with the engine not running), wherein the controller 12 may open isolation valve 110 and canister vent valve 114 while closing canister purge valve (CPV) 112 to direct refueling vapors into canister 22 while preventing fuel vapors from being directed into the intake manifold.

As another example, the fuel system may be operated in a refueling mode (e.g., when fuel tank refueling is requested by a vehicle operator), wherein the controller 12 may open isolation valve 110 and canister vent valve 114, while maintaining canister purge valve 112 closed, to depressurize the fuel tank before allowing enabling fuel to be added therein. As such, isolation valve 110 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 12 may open canister purge valve 112 and canister vent valve while closing isolation valve 110. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more oxygen sensors (not shown) may be coupled to the canister 22 (e.g., downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, MAP sensor 118, pressure sensor 120, and pressure sensor 129. Other sensors such as additional pressure, temperature, air/fuel ratio, and composition sensors may be coupled to various locations in the vehicle system 6. Additionally, the vehicle system may include one or more inertial motion sensors or other sensors that may be configured to determine the pitch of the vehicle. For example, the vehicle system may include a restraints control module (RCM) to control airbag deployment, for example, and the RCM may have an inertial motion sensor that outputs a pitch of the RCM, which can be used to determine the pitch of the vehicle. As another example, the actuators may include fuel injector 66, isolation valve 110, purge valve 112, vent valve 114, fuel pump 21, and throttle 62.

Control system 14 may further receive information regarding the location of the vehicle from an on-board global positioning system (GPS). Information received from the GPS may include vehicle speed, vehicle altitude, vehicle position, etc. This information may be used to infer engine operating parameters, such as local barometric pressure. Control system 14 may further be configured to receive information via the internet or other communication networks. Information received from the GPS may be cross-referenced to information available via the internet to determine local weather conditions, local vehicle regulations, etc. Control system 14 may use the internet to obtain updated software modules which may be stored in non-transitory memory.

The control system 14 may include a controller 12. The controller 12 receives signals from the various sensors of FIG. 1 and employs the various actuators of FIG. 1 to adjust engine operation based on the received signals and instructions stored on a memory of the controller. Controller 12 may be configured as a conventional microcomputer including a microprocessor unit, input/output ports, read-only memory, random access memory, keep alive memory, a controller area network (CAN) bus, etc. Controller 12 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines. Example control routines are described herein with regard to FIGS. 3-5, 6A, and 6B.

Further, an engine cooling fan 92 may be coupled to a radiator 80 in order to maintain an airflow through radiator 80 when the vehicle is moving slowly or stopped while the engine is running. The fan 92 and/or radiator 80 may be located at the front end of the vehicle in which they are installed, for example at the grille, so that ambient air may be drawn in the by the fan. In some examples, fan speed may be controlled by controller 12. Alternatively, fan 92 may be coupled to a different engine component.

During engine operation, the fan 92 may be operated to spin in a first, forward direction, also referred to as an engine operation direction. In the first direction, the fan may direct air from the environment in front of the vehicle to inside the engine compartment, over the engine and other associated components (e.g., radiator, coolant lines, other air-to-air or air-to-liquid heat exchangers, etc.), and out the back and/or sides of the vehicle.

The fan 92 may alternatively be operated to spin in a second, reverse direction. In the second direction, the fan may direct air from within the engine compartment (e.g., air surrounding the engine) and behind the engine/engine compartment to the environment outside of the vehicle, such as to the front of the vehicle. The fan may be controlled by a fan circuit that includes a motor and an H bridge, where the H bridge includes four switches (e.g., transistors) arranged into two sets of two switches, such that when a first set of switches is open (and a second set is closed), current flows in a first direction through the motor, causing the fan to spin in the first direction, and when the second set of the switches is open (and the first set is closed), current flows in a second, opposite direction through the motor, causing the fan to spin in the second direction. However, other configurations for operating the fan to spin in a first or second direction are possible.

As explained above, the fuel system includes a canister to absorb fuel vapors during a fuel tank refill, when fuel tank temperature increases above a threshold, and other conditions. One particular operating condition that can lead to increased fuel vapor production is an engine hot soak, where the engine is shutdown while operating at a relatively high temperature and/or during relatively high ambient temperatures. Because the coolant that normally flows through the engine during engine operation may no longer flow once the engine is shutdown, and because no ram air is present to cool the radiator and engine, the engine temperature may remain relatively high, or even increase, for a period following engine shutdown. During this time, heat may be transferred from the engine to neighboring components, including the fuel tank. Fuel vapors generated in the fuel tank may then be pushed out to the canister. However, the canister may become overloaded with vapors, and because performing a purge is not possible when the engine is not running, the overloaded canister may release fuel vapors to the environment, comprising emissions.

To prevent canister overloading when the engine is not running, heat from the engine may be prevented from reaching the fuel tank during a hot soak period. To accomplish this, the engine cooling fan may be operated after engine shut down for a duration, such as until engine temperature drops below a threshold. While operating the engine cooling fan in either of the forward or the reverse direction may act to remove heat from the engine, operation of the engine cooling fan in the forward direction (e.g., where air is moved from the front of the vehicle towards the engine) may result in that heat being transferred to the fuel tank, as vehicles are commonly arranged with an engine at the front of the vehicle and a fuel tank toward the rear of the vehicle (e.g., the engine may be located forward of the passenger compartment near the front axle, while the fuel tank may be located near the rear axle). Thus, to remove engine heat and prevent the engine heat from reaching the fuel tank, the fan may be operated in the reverse direction to draw out air surrounding the fuel tank and/or engine from the vehicle and to the environment at the front of the vehicle.

Thus, as explained above the fan may be operated in the second, reverse direction responsive to the engine shutting down when engine temperature is at or above a threshold temperature (e.g., normal engine operating temperature). Additionally, control of the engine fan after engine shut down may be based on an elevation difference between the engine and fuel tank. While the engine and fuel tank may be installed at a relatively equal vertical position (relative to a neutral vertical position, such as sea level) and hence have little or no vertical displacement when the vehicle is operated on flat ground, the vertical displacement of the fuel tank relative to the engine may shift when the vehicle is operated or parked on an incline or decline. Depending on the configuration of the engine and fuel tank and the direction of the grade, during some conditions the engine may be positioned vertically below the fuel tank, while during other conditions, the engine may be positioned vertically above the fuel tank. When the engine is positioned vertically above the fuel tank, it is unlikely significant heat will be rejected from the engine to the fuel tank, given the propensity for heat to rise. Thus, the engine cooling fan may not be operated when the engine is located vertically above the fuel tank. In additional or alternative examples, the speed of the engine cooling fan may be adjusted based on the vehicle grade and/or the threshold engine temperature.

FIGS. 2A-2C illustrate an example vehicle 202 that includes the vehicle system 6 of FIG. 1, including the engine 10 and fuel tank 20. In diagram 200 of FIG. 2A, vehicle 202 is positioned on a surface 204 that is relatively flat. Accordingly, the grade of the vehicle is equal to horizontal, herein defined as being at an angle of 0°. As such, the fuel tank and engine are located at the same elevation (e.g., vertical displacement) relative to a reference elevation, such as sea level. As shown by the markers on the left side of diagram 200, the elevation 208 of the engine is the same as the elevation 209 of the fuel tank, and both elevations are vertically displaced by the same amount relative to the reference elevation 206.

In diagram 210 of FIG. 2B, surface 204 on which vehicle 202 is resting is angled at a decline, and as such the vehicle points nose-down. Thus, the grade of the vehicle is at a negative angle relative to horizontal, such as an angle of −15°. As such, because the fuel tank is located at the rear of the vehicle and the engine is located at the front of the vehicle, when the vehicle grade is negative (e.g., less than zero, declined relative to horizontal, etc.), the vertical displacement of the fuel tank is greater than the vertical displacement of the engine relative to the reference elevation. As shown by the markers on the left side of diagram 210, the elevation 208 of the engine is less than the elevation 209 of the fuel tank relative to the reference elevation 206.

In diagram 220 of FIG. 2C, surface 204 on which vehicle 202 is resting is angled at an incline, and as such the vehicle points nose-up. Thus, the grade of the vehicle is at a positive angle relative to horizontal, such as an angle of 15°. As such, because the fuel tank is located at the rear of the vehicle and the engine is located at the front of the vehicle, when the vehicle grade is positive (e.g., greater than zero, inclined relative to horizontal, etc.), the vertical displacement of the engine is greater than the vertical displacement of the fuel tank relative to the reference elevation. As shown by the markers on the left side of diagram 220, the elevation 208 of the engine is greater than the elevation 209 of the fuel tank relative to the reference elevation 206.

Thus, as illustrated by FIGS. 2A-2C, the vehicle grade affects the vertical displacement of the fuel tank relative to the engine. When the engine has a vertical displacement equal to or less than that of the fuel tank, as shown in FIGS. 2A and 2B, heat dissipated from the engine may be transferred to the fuel tank. Thus, when the vehicle grade is zero (e.g., the vehicle is on flat ground) or less than zero (e.g., the vehicle is pointed nose-down), the engine cooling fan may be operated following engine shut down when engine temperature is greater than a threshold temperature, in order to prevent heat rejection to the fuel tank. However, when the engine has a vertical displacement greater than that of the fuel tank, as shown in FIG. 2C, heat dissipated from the engine may be rejected to the environment above the engine and thus may not be transferred to the fuel tank. Thus, when the vehicle grade is greater than zero (e.g., the vehicle is pointed nose-up), the engine cooling fan may not be operated following engine shutdown, even if the engine temperature is above the threshold. In other examples, when the vehicle grade is greater than zero, the engine cooling fan may be operated following engine shutdown when engine temperature is above the threshold, but at a lower speed and/or for a shorter duration than when the vehicle grade is equal to or less than zero. In still further examples, the engine cooling fan may be operated following engine shutdown every time the engine temperature is above a threshold, but the threshold may vary based on the vehicle grade. For example, the threshold temperature may increase as the vehicle grade increases.

Turning to FIG. 3, a method 300 for operating an engine cooling fan is presented. Instructions for carrying out method 300 and all subsequently-presented methods may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 302, method 300 includes determining operating parameters. The determined operating parameters may include engine speed and load, vehicle speed, engine temperature, ambient temperature, engine operation status (e.g., on/off), and other parameters. At 304, method 300 includes determining if an engine shutdown request is received. An engine shutdown request may be detected based on an ignition key or button being moved to an off position, based on vehicle brake and/or accelerator position and vehicle speed (e.g., if the vehicle includes an automatic stop function, the engine may be automatically shut down once vehicle speed drops below a threshold), and/or based on command to switch from engine operation to battery operation in a hybrid vehicle. If an engine shutdown request is not received, method 300 proceeds to 306 to selectively operate an engine cooling fan, such as fan 92 of FIG. 1, in a first, forward direction based on moving engine conditions, which will be explained in more detail below with respect to FIG. 4. Method 300 then returns.

If it is determined that an engine shutdown request has been received (or if it is determined the engine has been shutdown), method 300 proceeds to 308 to determine if vehicle speed is below a threshold. As explained above, in hybrid vehicles configured to be propelled by torque produced by the engine or by a battery assist system (e.g., battery-powered motor), the engine may be shut down but the vehicle may continue to move. If the vehicle is moving at a relatively high speed, operation of the engine cooling fan may not be needed, as ram air may provide sufficient cooling. Accordingly, if the vehicle speed is not below a threshold (e.g., 5 or 10 MPH), method 300 proceeds to 309 to not operate the engine cooling fan, and then method 300 returns to 308 to continue to monitor if the vehicle speed is below the threshold.

If the vehicle speed is below the threshold, method 300 proceeds to 310 to determine engine temperature and vehicle grade. Engine temperature may be determined based on output from an engine temperature sensor, which may measure the temperature of the coolant circulating in or exiting the engine coolant jackets. Vehicle grade may be determined based on vehicle pitch as measured by an inertial motion sensor, or other suitable mechanism. In some examples, ambient temperature may also be determined, from an ambient temperature sensor (e.g., in the engine intake) or other suitable mechanism.

At 312, method 300 determines if engine temperature is greater than a threshold temperature. The threshold may be a suitable temperature, such as normal operating temperature, at or above which an external cooling mechanism may be activated to avoid engine overheating or fuel vapor generation. In some examples, the threshold temperature may be a fixed temperature. In other examples, the threshold temperature may vary based on operating conditions, such as vehicle grade and/or ambient temperature.

If it is determined that engine temperature is not greater than the threshold, method 300 proceeds to 314 to shut down the engine and not operate the engine cooling fan once the engine is shut down. When the engine is relatively cool (e.g., below the threshold temperature), the energy expenditure required to operate the engine cooling fan may not be warranted, as risk of engine overheating or fuel vapor generation is low. Method 300 then returns.

If it is determined at 312 that engine temperature is greater than the threshold, method 300 proceeds to 316 to determine if the vehicle grade is flat or declined. If the vehicle grade is not flat or declined, that is if the vehicle grade is inclined (e.g., the vehicle is pointed nose-up), method 300 proceeds to 314 to not operate the engine cooling fan in a reverse direction, as the engine is positioned vertically above the fuel tank and hence heat from the engine will not reach the fuel tank. In some examples, when the vehicle grade is at an incline, not operating the engine cooling fan in the reverse direction comprises not operating the engine cooling such that the fan is off and no air is moved over the engine. In other examples, not operating the engine cooling fan in the reverse direction may include operating the engine cooling fan in the forward direction. Method 300 then returns.

On the other hand, if it is determined that the vehicle grade is flat or declined, that is if the vehicle grade is zero or less (e.g., if the vehicle is positioned nose-down), method 300 proceeds to 318 to shut down the engine and operate the engine cooling fan in the second, reverse direction. In the reverse direction, air surrounding fuel tank is drawn toward the engine out the front of the vehicle, and thus air is removed from around the engine and away from the fuel tank. In some examples, the fan operation may be adjusted based on operating conditions, such as engine temperature, fuel tank level, fuel tank temperature, canister loading state, and/or vehicle grade, as indicated at 320. For example, the fan may be operated at a higher speed when engine temperature is higher and/or when vehicle grade is lower (lower than zero, such that the engine is lower than the fuel tank). In another example, the fan may not be operated, or may be operated at lower speeds, when the fuel tank level is relatively low and/or when the fuel tank temperature is relatively low, as fuel vapor generation may be low during these conditions. In a still further example, the fan may be operated at a higher speed, or may be activated at a lower engine temperature, when the fuel vapor canister loading is high, as any generated fuel vapors may be passed to atmosphere during these conditions, and thus it may be desirable to prevent even the smallest amounts of fuel vapors by increasing fan speed and/or fan operation at lower temperatures. At 322, method 300 includes stopping fan operation once the engine temperature drops below the threshold. Additionally, in some examples estimates of fuel vapor loading on the fuel vapor canister, used to determine when to perform a canister purge and/or a duration a purge is to be performed, may be updated based on the fan operation. For example, canister loading may be based on fuel tank temperature and pressure over time. This estimated canister loading may be adjusted (e.g., reduced) based on the duration that the fan is operated in the reverse direction. Method 300 then returns.

Thus, an engine cooling fan may be powered after an engine shutdown to blow air away from the engine and fuel tank. The adjustment may be based on engine temperature and vehicle grade, such that the fan is only operated when engine temperature is above a threshold and/or when vehicle grade is at or below a threshold grade (such as zero). In this way, engine heat produced during a hot soak period may be prevented from reaching the fuel tank, lowering production of fuel vapors and reducing the risk of canister overload. Additionally, operation of the engine cooling fan may be regulated based on vehicle grade to avoid usage of the fan during conditions where the engine heat is naturally unlikely to reach the fuel tank. Together, the embodiments disclosed herein provide for maintaining an engine and fuel tank at a desired temperature without unnecessary energy expenditure.

Turning now to FIG. 4, a method 400 for operating an engine cooling fan, such as fan 92 of FIG. 1, in a first, forward direction during moving engine conditions is illustrated. Method 400 may be executed while the engine is spinning and combustion is occurring. At 402, method 400 includes determining operating conditions. The operating conditions may include engine speed and load, vehicle speed, grill shutter position, and other operating conditions. At 404, method 400 includes selectively operating the engine cooling fan in the forward direction based on conditions.

Selectively operating the fan may include adjusting the on/off status of the fan and/or adjusting the speed of the fan, as indicated at 406. Fan operation (e.g., speed and/or simply on/off) may also be based on vehicle speed, ambient temperature, engine load, engine temperature, and grill shutter position, as indicated at 408. For example, the fan may be operated when vehicle speed is below a threshold and the engine is operating, as ram air created by vehicle movement may not be sufficient to maintain engine temperature at a desired temperature. In the forward direction, ambient air is drawn into the front of the vehicle and travels over the engine and toward the fuel tank. In another example, engine fan operation may be coordinated with grill shutter opening of grill shutters at a font of the vehicle.

During vehicle traveling conditions, fan operation, including fan speed, may optionally be based on vehicle grade, as indicated at 410 of method 400. In some examples, fan operation during vehicle traveling conditions may be independent of vehicle grade. Alternatively, fan operation may be based on grade in that a positive grade can indicate high engine load expected and thus pre-cooling may be used where the fan is operated even if engine coolant temperature is below a threshold normally required to activate the cooling fan. Alternatively, during a negative grade vehicle traveling condition, engine fan operation may be delayed and not operated even if coolant temperature is above that threshold in the expectation that lower engine loads are to be encountered and increased cooling will be available so that current resources are not wasted on cooling fan operation that is likely to become unnecessary shortly. Method 400 then returns.

While the examples described above relating vehicle grade to fuel tank displacement relative to engine displacement were described with respect to a vehicle configuration where a fan is located at the front of the vehicle and an engine located between the fan and a fuel tank at the rear of the vehicle, the disclosure is not limited to such configurations and other configurations are possible. For example, in some vehicles the fuel tank may be located towards the front of the vehicle and the engine located towards the rear of the vehicle. In these vehicles, the fuel tank may be vertically above the engine when the vehicle is positioned nose-up (e.g., at an incline) rather than when the vehicle is positioned nose-down, as described.

When the engine cooling fan is operated in the reverse direction following an engine shutdown event, heat rejection from the engine to the fuel tank may be reduced. As explained above, this may help lower fuel vapor generation and prevent canister overloading. However, following some engine shutdown events, a fuel system leak test may be conducted to ensure leaks are not present in the fuel system. During the leak detection test, a pressure increase in the fuel system resulting from a temperature increase in the fuel tank may be monitored. Thus, if the engine cooling fan is operated during this time, standard leak detection tests may result in a false positive indication of a leak if the fan operation prevents adequate pressure from building in the fuel system. Thus, in some examples, a leak detection test may be modified based on cooling fan operation, as explained below with respect to FIGS. 5-6B.

FIG. 5 is a flow chart illustrating a method 500 for performing a leak detection routine in an engine system, such as the engine system described above with respect to FIG. 1. Method 500 begins at 502, where it is determined if an engine shutdown request has been received. If no engine-off event is detected, method 500 proceeds to 504 to record that leak test was aborted, and set a flag to retry the leak test at the next detected engine-off event. Method 500 may then end. If an engine-off event is detected, method 500 proceeds to 506.

At 506, method 500 includes determining whether entry conditions for a leak test are met. Entry conditions may include a threshold amount of time passed since the previous leak test was performed, a threshold length of engine run time prior to the engine-off event, a threshold amount of fuel in the fuel tank, and a threshold battery state of charge. For hybrid electric, plugin-hybrid electric, and other vehicles capable of being powered during an engine-off event, the entry conditions may also include a vehicle-off condition. If entry conditions are not met, method 500 proceeds to 504, as explained above. If entry conditions are met, method 500 proceeds to 508.

Although entry conditions may be met at the beginning of method 500, this may change during the execution of the method. For example, an engine restart or refueling event may be sufficient to abort the method at any point prior to completing method 500. If such events are detected that would interfere with the performing of method 500 or the interpretation of results derived from executing method 500, method 500 may proceed to 504, record that a leak test was aborted, and set a flag to retry the leak test at the next detected engine-off event, and then end.

At 508, method 500 includes determining engine temperature and vehicle grade. The engine temperature and vehicle grade may be used to determine if engine cooling fan operation in the reverse direction is indicated, as explained above with respect to FIG. 3. At 510, it is determined if the engine cooling fan is to be operated in the reverse direction. If yes, method 500 proceeds to 512 to perform a modified leak test, which will be explained in more detail below with respect to FIGS. 6A and 6B. Briefly, the operation of the cooling fan may reduce the pressure rise in the fuel system during the leak detection test, and thus operation of the cooling fan may be delayed until the test is complete, or the fan may be operated in the forward direction to transfer at least some heat from the engine to the fuel tank. In other examples, the test may be carried out while the fan operates in the reverse direction, but the pressure threshold may be lowered to account for lower pressure rise in the fuel system. In a still further example, the leak test may include monitoring vacuum build in addition or alternative to the pressure rise. Method 500 then returns.

However, if it is determined that the engine cooling fan is not to be operated in the reverse direction, method 500 proceeds to 514 to perform the leak detection test. This may include closing the canister vent valve (CVV), such as CVV 114 of FIG. 1, to isolate the fuel system from atmosphere, and measuring pressure in the fuel system, as indicated at 516. The peak pressure reading may be compared to a threshold and/or the pressure rate of change may be compared to a threshold rate. If the peak pressure and/or pressure rate do not meet or exceed a threshold pressure or rate, it may indicate that a leak is present, and hence at 518, method 500 includes indicating a leak if the pressure does not meet a condition, such as meeting or exceeding a threshold pressure. When a leak is indicated, an operator may be notified, a diagnostic code may be set, and/or engine operating parameters may be adjusted. Method 500 then returns.

Turning now to FIGS. 6A and 6B, methods 600 and 650 for performing a modified leak detection test are presented. As explained above, a modified leak detection test may be performed when vehicle conditions indicate an engine cooling fan is to be operated in a reverse direction following an engine-off event, for example when engine temperature is above a threshold temperature and vehicle grade is at or below a threshold grade. Method 600 and/or 650 may be performed at part of method 500, for example in response to an indication to perform a leak detection test and after determining the engine cooling fan is to be operated in the reverse direction at 510.

Referring first to FIG. 6A, it illustrates a first method 600 for performing a modified leak detection test. At 602, method 600 includes closing the CVV to isolate the fuel system from atmosphere and monitoring the resultant pressure rise. At 604, method 600 may include delaying operation of the engine cooling fan until the pressure in the fuel system reaches a threshold pressure. Additionally or alternatively, 604 may also include operating the engine cooling fan in the forward direction until the threshold pressure is reached. In this way, the movement of the engine heat away from the fuel tank that would be provided by the engine cooling fan operating in the reverse direction may be delayed until the pressure in the system reaches a suitable pressure (e.g., the threshold pressure for confirming that no leak in the system is present). Alternatively, the fan may be operated in the forward direction until the pressure in the system reaches the suitable pressure in order to direct at least some heat to the fuel tank and/or still allow for some engine cooling during the leak test. However, because delaying operation of the fan, or operating the fan in the forward direction, may cause purposeful generation of fuel vapors, such actions may only be carried out if the canister load is below a threshold, as indicated at 606, so that fuel vapors are not emitted to the atmosphere.

Further, as indicated at 608, in some examples the threshold pressure and/or pressure rate used in the leak test may be adjusted based on the fan operation. For example, rather than delay or adjust the direction of the fan operation, the fan may be operated in the reverse direction and the leak detection test performed by closing the CVV and monitoring the pressure rise. However, the threshold pressure needed to indicate a leak does not exist may be lowered when the fan is operated in the reverse direction, or the rate of pressure rise may be lowered, to account for the cooling impact of the fan on the pressure rise.

At 610, method 600 includes indicating a leak if the pressure rise does not meet a condition (e.g., if the pressure does not reach the threshold and/or if the pressure does not rise at a rate equal to or greater than the threshold pressure rate). Similar to leak test described with respect to FIG. 5, if a leak is indicated, an operator may be notified, a diagnostic code may be set, and/or engine operating parameters may be adjusted. Method 600 then returns.

In some examples, a leak detection test may include monitoring of vacuum that results after the fuel system heats up and then cools back down to ambient temperature. The vacuum leak test may be performed after a leak is indicated from the positive pressure test, described above, in order to confirm the leak, or it may be performed without first performing the positive pressure test. FIG. 6B shows a method 650 for performing a leak detection test using vacuum. Method 650 may be performed on its own, without first performing method 600, or it may be performed following an indication of a leak. Because method 650 relies on vacuum generation in the fuel system resulting from diurnal temperature swing, it may be particularly suited to operation with the engine cooling fan in the reverse direction, as the fan operation may rapidly decrease the temperature in the fuel system.

At 652, method 650 includes closing the CVV and monitoring the vacuum build. If method 650 is performed after a positive pressure leak test, the CVV may be opened after the positive pressure test has ended, in order to release the built up pressure, before the valve is closed again to isolate the fuel system from atmosphere.

At 654, method 650 includes operating the engine cooling fan in the reverse direction to cool the fuel tank. At 656, method 650 includes indicating a leak if vacuum build does not meet condition. For example, peak vacuum may be compared to a vacuum threshold, and if the vacuum is less than the threshold, a leak is indicated. In another example, vacuum rate may be compared to a vacuum rate threshold, and if the measured vacuum rate is less than the rate threshold, a leak may be indicated. Additionally, the threshold vacuum or vacuum rate may be adjusted based on the fan operation, for example the vacuum rate threshold may be increased as fan speed increases. Method 650 then returns.

FIG. 7 is a diagram 700 showing example operating parameters during the execution of one or more of the methods described above. Specifically, diagram 700 illustrates vehicle speed, engine speed, engine temperature, vehicle grade, and engine cooling fan status during a given period of operation that includes time points t1 and t2. For each operating parameter, time is depicted along the x-axis and values of each operating parameter are depicted along the y-axis. For fan status, values of off, operating with the forward spin direction (frd), and operating with the reverse spin direction (rev) are shown.

Prior to time t1, the vehicle is moving above a threshold speed, as shown by curve 702. Further, engine temperature is at normal operating temperature, as shown by curve 706, and vehicle grade is initially flat (at zero), as shown by curve 708. Accordingly, operation of the engine cooling fan is not warranted, and thus the fan is off, as shown by curve 710.

At time t1, vehicle speed drops below a threshold speed, as the vehicle may slowing down in preparation to come to a stop, for example. When the vehicle speed drops below the threshold, the engine is still running, as shown by engine speed curve 704. To prevent engine overheating that may result due to the lack of ram air to cool the radiator and engine, the fan is activated to operate in the forward direction.

At time t2, the engine is shut down, for example in response to an operator request to shut off the engine. Thus, after time t2, engine speed reduces until it reaches zero, indicating the engine is at rest. However, engine temperature is still at or above normal operating temperature. Further, prior to time t1, the vehicle grade had changed from zero to less than zero, and remained constant after time t1. Thus, because the engine is at rest, engine temperature is above a threshold, and vehicle grade is below a threshold, the engine cooling fan is adjusted to operate in the reverse spin direction.

The technical effect of operating an engine cooling fan in a reverse direction based on engine temperature and vehicle grade is to reduce fuel vapor production without unnecessarily operating the fan.

A method for an engine includes after an engine shutdown request is received, adjusting an engine cooling fan based on an engine temperature and an elevation of a fuel tank relative to the engine. In a first example of the method, adjusting the engine cooling fan comprises powering the engine cooling fan in a reverse direction to blow air from the engine to outside the engine and away from the fuel tank. A second example of the method optionally includes the first example and further includes wherein adjusting the engine cooling fan based on engine temperature and the elevation of the fuel tank comprises adjusting the cooling fan in response to engine temperature being greater than a threshold and the elevation of the fuel tank being equal to or greater than an elevation of the engine. A third example of the method optionally includes one or more of the first and second examples, and further includes wherein the elevation of the fuel tank relative to the engine is determined based on a grade of a vehicle in which the engine and fuel tank are installed. A fourth example of the method optionally includes one or more of the first through third examples, and further includes, after the engine shutdown request is received and when the elevation of the fuel tank is lower than the elevation of the engine, not powering the engine cooling fan. A fifth example of the method optionally includes one or more of the first through fourth examples, and further includes during engine operation, powering the engine cooling fan in a forward direction to blow ambient air to the engine. A sixth example of the method optionally includes one or more of the first through fifth examples, and further includes wherein powering the engine cooling fan in the reverse direction comprises de-energizing a first pair of transistors and energizing a second pair of transistors in a circuit of the engine cooling fan.

Another method for an engine in a vehicle comprises after an engine shutdown request is received, powering an engine cooling fan to spin in a reverse direction from an engine operating direction in response to one or more of engine temperature greater than a threshold and vehicle grade. In a first example of the method, powering the engine cooling fan to spin in a reverse direction in response to one or more of engine temperature greater than a threshold and vehicle grade comprises, when vehicle grade is less than or equal to a threshold grade, powering the engine cooling fan to spin in the reverse direction. A second example of the method optionally includes the first example and further includes wherein powering the engine cooling fan to spin in a reverse direction in response to one or more of engine temperature greater than a threshold and vehicle grade comprises, when vehicle grade is greater than the threshold grade, not powering the engine cooling fan. A third example of the method optionally includes one or more of the first and second examples, and further includes wherein the threshold grade is zero. A fourth example of the method optionally includes one or more of the first through third examples, and further includes wherein powering the engine cooling fan to spin in a reverse direction in response to one or more of engine temperature greater than a threshold and vehicle grade comprises powering the engine cooling fan to spin in the reverse direction when engine temperature is above the threshold temperature and vehicle grade is equal to or less than a threshold grade. A fifth example of the method optionally includes one or more of the first through fourth examples, and further includes, prior to receiving the shutdown request, powering the engine cooling fan to spin in the engine operating direction in response to vehicle speed being below a threshold vehicle speed.

An additional method for a vehicle comprises during engine operation, selectively operating an engine cooling fan with a forward spin direction; and after an engine shutdown request is received, operating the engine cooling fan with a reverse spin direction when an engine temperature is greater than a threshold temperature; and adjusting a speed of the engine cooling fan in the reverse spin direction as a function of vehicle grade. In a first example of the method, adjusting the speed of the engine cooling fan in the reverse spin direction as a function of vehicle grade comprises increasing the speed of the engine cooling fan in the reverse direction as vehicle grade decreases. A second example of the method optionally includes the first example and further includes wherein adjusting the speed of the engine cooling fan in the reverse spin direction as a function of vehicle grade comprises: operating the engine cooling fan with the reverse spin direction at a first speed when engine temperature is greater than the threshold temperature and vehicle grade is above a threshold grade; and operating the engine cooling fan with the reverse spin direction at a second speed when engine temperature is greater than the threshold temperature and vehicle grade is equal to or below the threshold grade. A third example of the method optionally includes one or more of the first and second examples, and further includes wherein the first speed is slower than the second speed, and wherein the threshold grade is zero. A fourth example of the method optionally includes one or more of the first through third examples, and further includes wherein selectively operating the engine cooling fan with the forward spin direction comprises operating the engine cooling fan with the forward spin direction in response to vehicle speed below a threshold speed, and wherein in the forward spin direction, the engine cooling fan is configured to direct ambient air from outside the vehicle toward an engine and fuel tank of the vehicle, and wherein in the reverse spin direction, the engine cooling fan is configured to direct air surrounding the fuel tank and engine to outside the vehicle. A fifth example of the method optionally includes one or more of the first through fourth examples, and further includes, after receiving the request to shut down the engine, determining if a leak detection test is to be performed, and when it is determined the leak detection test is to be performed, delaying operation of the engine cooling fan with the reverse spin direction until after the leak detection test is complete. A sixth example of the method optionally includes one or more of the first through fifth examples, and further includes after receiving the request to shut down the engine, determining if a leak detection test is to be performed, and when it is determined the leak detection test is to be performed, adjusting a pressure threshold of the leak detection test based on the speed of the engine cooling fan.

In another representation, a method for an engine comprises after an engine shutdown request is received, powering an engine cooling fan to spin in a reverse direction from an engine operating direction in response to engine temperature greater than a threshold, the threshold based on an inclination angle between a fuel tank and the engine. The inclination angle may refer to the angle of inclination of the engine relative to the fuel tank, such that as the inclination angle increases, the fuel tank increases in vertical displacement relative to a horizontal axis compared to the fuel tank. In one example, the threshold temperature may decrease as the inclination angle decreases.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

after an engine shutdown request is received, and while the engine is shut down, adjusting an engine cooling fan based on an engine temperature and an elevation of a fuel tank relative to the engine.

2. The method of claim 1, wherein adjusting the engine cooling fan comprises powering the engine cooling fan in a reverse direction to blow air from the engine to outside the engine and away from the fuel tank.

3. The method of claim 2, wherein adjusting the engine cooling fan based on engine temperature and the elevation of the fuel tank comprises adjusting the cooling fan in response to engine temperature being greater than a threshold and the elevation of the fuel tank being equal to or greater than an elevation of the engine.

4. The method of claim 3, wherein the elevation of the fuel tank relative to the engine is determined based on an angle of a surface on which a vehicle is positioned, and wherein the engine and fuel tank are installed in the vehicle.

5. The method of claim 3, further comprising, after the engine shutdown request is received and when the elevation of the fuel tank is lower than the elevation of the engine, not powering the engine cooling fan.

6. The method of claim 3, further comprising, during engine operation, powering the engine cooling fan in a forward direction to blow ambient air to the engine.

7. The method of claim 2, wherein powering the engine cooling fan in the reverse direction comprises de-energizing a first pair of transistors and energizing a second pair of transistors in a circuit of the engine cooling fan.

8. A method for a vehicle engine, comprising:

after an engine shutdown request is received, while the engine is shut down, powering an engine cooling fan to spin in a reverse direction from an engine operating direction responsive to engine temperature greater than a threshold temperature and an angle of a surface on which the vehicle is positioned less than or equal to a threshold angle, and not powering the fan when the angle of the surface is greater than the threshold angle.

9. The method of claim 8, wherein powering the engine cooling fan to spin in a reverse direction in response to engine temperature greater than the threshold temperature and the angle of the surface, comprises, when the angle of the surface is less than or equal to a threshold angle, powering the engine cooling fan to spin in the reverse direction.

10. The method of claim 9, wherein the threshold angle is zero.

11. The method of claim 8, wherein powering the engine cooling fan to spin in a reverse direction in response to engine temperature greater than the threshold temperature and the angle of the surface comprises powering the engine cooling fan to spin in the reverse direction when engine temperature is above the threshold temperature and the angle of the surface is equal to or less than a threshold angle.

12. The method of claim 8, further comprising, prior to receiving the engine shutdown request, powering the engine cooling fan to spin in the engine operating direction in response to vehicle speed being below a threshold vehicle speed.

13. A method for a vehicle comprising:

during engine operation, selectively operating an engine cooling fan with a forward spin direction; and after an engine shutdown request is received, while the engine is shut down, operating the engine cooling fan with a reverse spin direction when an engine temperature is greater than a threshold temperature; and adjusting a speed of the engine cooling fan in the reverse spin direction as a function of an angle of a surface on which the vehicle is positioned.

14. The method of claim 13, wherein adjusting the speed of the engine cooling fan in the reverse spin direction as a function of the angle of the surface comprises increasing the speed of the engine cooling fan in the reverse direction as the angle of the surface decreases.

15. The method of claim 13, wherein adjusting the speed of the engine cooling fan in the reverse spin direction as a function of the angle of the surface comprises:

operating the engine cooling fan with the reverse spin direction at a first speed when engine temperature is greater than the threshold temperature and the angle of the surface is above a threshold angle; and operating the engine cooling fan with the reverse spin direction at a second speed when engine temperature is greater than the threshold temperature and the angle of the surface is equal to or below the threshold angle.

16. The method of claim 15, wherein the first speed is slower than the second speed, and wherein the threshold angle is zero.

17. The method of claim 13, wherein selectively operating the engine cooling fan with the forward spin direction comprises operating the engine cooling fan with the forward spin direction in response to vehicle speed below a threshold speed, and wherein in the forward spin direction, the engine cooling fan is configured to direct ambient air from outside the vehicle toward an engine and fuel tank of the vehicle, and wherein in the reverse spin direction, the engine cooling fan is configured to direct air surrounding the fuel tank and engine to outside the vehicle.

18. The method of claim 13, further comprising, after receiving the request to shut down the engine, determining if a leak detection test is to be performed, and when it is determined the leak detection test is to be performed, delaying operation of the engine cooling fan with the reverse spin direction until after the leak detection test is complete.

19. The method of claim 13, further comprising, after receiving the request to shut down the engine, determining if a leak detection test is to be performed, and when it is determined the leak detection test is to be performed, adjusting a pressure threshold of the leak detection test based on the speed of the engine cooling fan.

* * * * *